United States Patent [19]

Wilson

[11] 4,032,150

[45] June 28, 1977

[54] PADDLE AND PUCK GAME EQUIPMENT

[76] Inventor: David C. Wilson, 35 Manor Loop, Roseburg, Oreg. 97470

[22] Filed: May 14, 1975

[21] Appl. No.: 577,329

[52] U.S. Cl. ..... 273/126 R; 273/127 B; 273/129 B

[51] Int. Cl.[2] ..... A63F 3/00

[58] Field of Search ..... 273/126 R, 119 R, 118 R, 273/127 R, 127 B, 85 R

[56] References Cited

UNITED STATES PATENTS

| | | | |
|---|---|---|---|
| 746,993 | 12/1903 | Roat, Jr. | 273/127 B |
| 2,824,739 | 2/1958 | Frank | 273/126 R |
| 2,841,398 | 7/1958 | Conner | 273/119 R |
| 3,466,042 | 9/1969 | Lucci | 273/127 R X |
| 3,734,504 | 5/1973 | Breslou | 273/126 R |

OTHER PUBLICATIONS

Amsco Toys Catalog; 1966 (Mar. 10, 1966).

*Primary Examiner*—Richard C. Pinkham
*Assistant Examiner*—T. Brown
*Attorney, Agent, or Firm*—Clarence M. Crews

[57] ABSTRACT

A paddle and puck game is provided in which each player is equipped with two paddles but must defend three goals. The playing equipment comprises an open tray, which provides a playing surface and opposite goals. The playing surface is marked with a center line to divide the available ranges of activity of the opposing players to their own separate courts. Near each end of the tray the side walls are slotted, removably to receive goal strips. Each goal strip generally includesthree scoring slots of different scoring values in its lower border. Goal strips of varying difficulty may be provided to accommodate players of differing levels of ability, and to permit goals of unequal difficulty to be used simultaneously at opposite ends for handicapping purposes. The goal spaces behind the slots are partitioned off from one another so that a scoring puck will generally be appropriately trapped, for avoiding disagreement as to which goal slot it passed through. Angular deflecting pieces are fixed behind the goals to avoid direct rebounding to a free area of a scoring puck. The lower margins of the side walls and the goal strips, as well as the lateral face portions of the puck, are desirably coated with a rubbery material such as neoprene, to deaden the sound and to increase the liveliness of rebounding of the puck.

6 Claims, 4 Drawing Figures

PADDLE AND PUCK GAME EQUIPMENT

This invention relates to game equipment, and more particularly to equipment of a kind in which a puck and paddles are used.

The game equipment desirable includes a choice of large and small pucks, two paddles for each player, and a playing tray having a smooth and unbroken playing surface, side and end walls, and goal strips, each of which has its ends slidably and snugly received in aligned slots of the side walls.

The goal strips are spaced inward from the tray ends, and normally each has three slots in its lower border to be guarded by only the two paddles of the player defending that goal. The scoring side slots at each end provide for relatively easy scoring, while the center slot is relatively difficult. A higher score is awarded for scoring through an opponent's center slot than in either of his side slots.

To avoid arguments, the spaces behind the respective scoring slots are partitioned off, so that a scoring puck will normally be trapped. Angular deflecting members are provided in the end disclosure to minimize direct rebounding to the playing area of a scoring puck.

The paddles are desirably made substantially longer than the heights of the goal strips, to avoid the mashing of a thumb of a goal defending player between the goal strip and the paddle.

For suppressing noise and increasing liveliness, the circumferential surface of the puck and the lower margins of the side walls and the goal strips are desirably coated with a rubbery material such as neoprene.

The removability of the goal strips enables substitution of pairs of goal strips of varying difficulty to be used according to the capabilities of the players. Goal strips of unequal difficulty may be simultaneously used when players known to be of unequal ability are opposed to one another.

In the drawing forming part of this specification,

Figure 1:
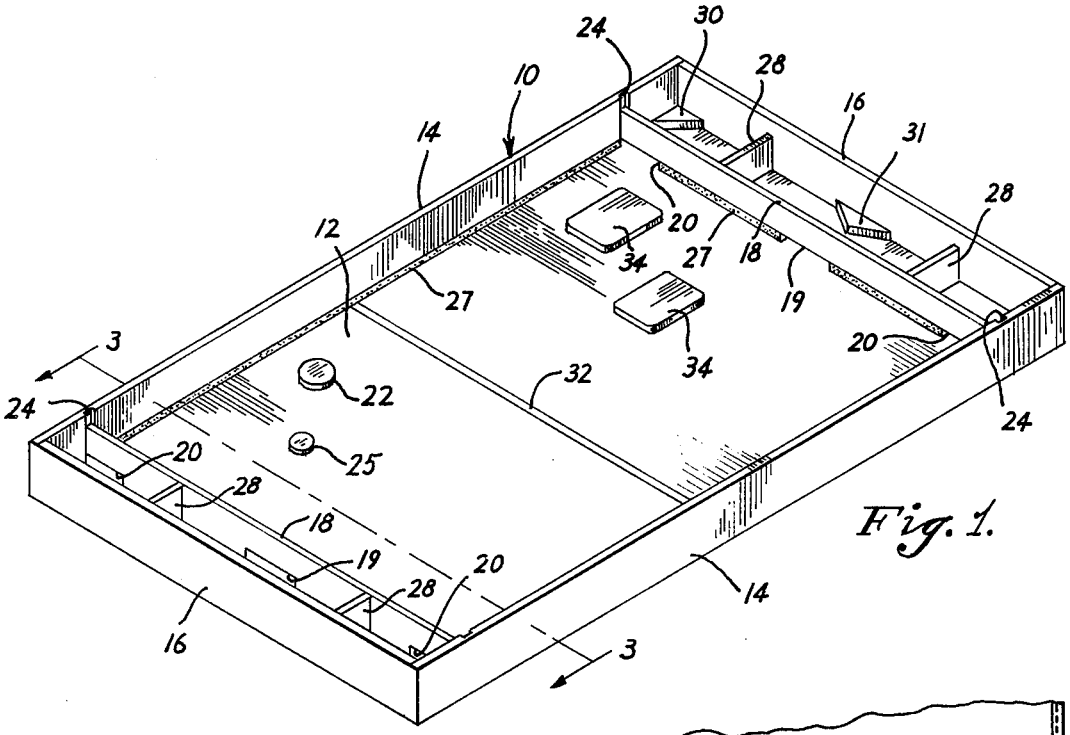
FIG. 1 is a perspective view of a playing tray as seen from above with two paddles and two pucks lying loose on the playing surface.
Figure 2:
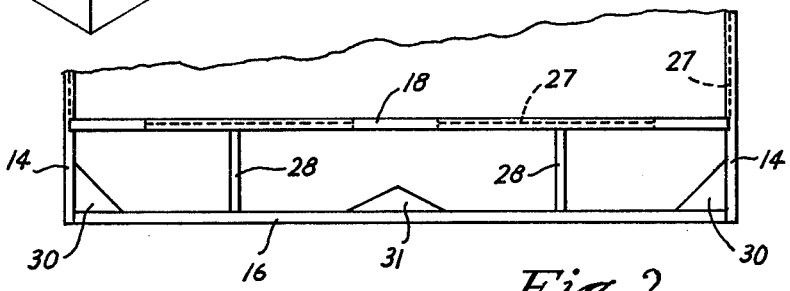
FIG. 2 is a fragmentary plan view of one end of the playing tray.
Figure 3:
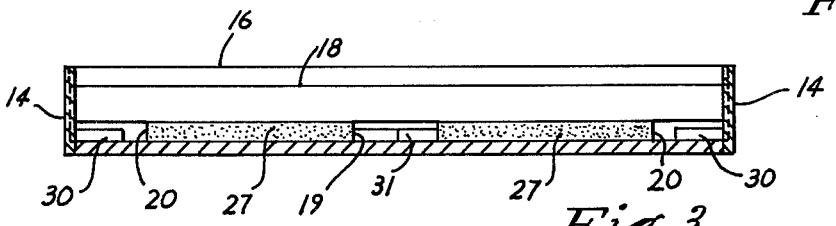
FIG. 3 is a view in sectional elevation taken on the line 3—3 of FIG. 1.
Figure 4:
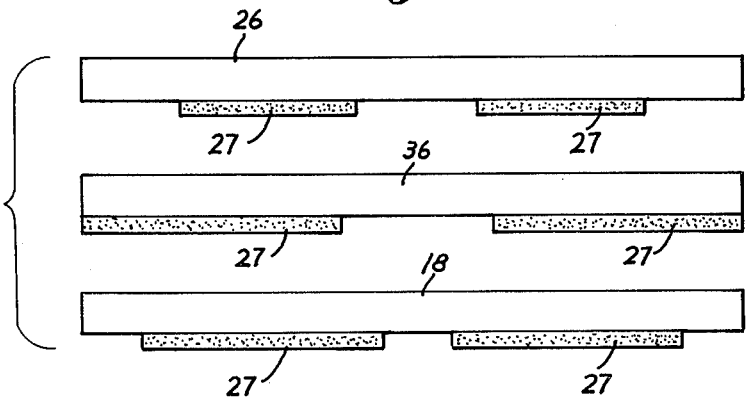
FIG. 4 is a view showing one of each type of goal strip provided.

The tray 10 shown in the drawing may illustratively measure five feet long and three feet wide. It desirably comprises a rectangular floor member 12 of plywood or other suitable rigid, sheet material having a smooth, substantially friction-free, upper surface. All the wall and partition members to be described may desirably be composed of the same material. Side walls 14 and end walls 16, both of half-inch plywood, surround the floor member and are firmly affixed to it and to one another by suitable fastening members such as ordinary wood screws (not shown). The side and end walls desirably measure four and one-half inches in height and stand four inches above the playing surface of the floor member 12. Spaced inward about four inches from each end wall 16 is a goal strip 18 which measures a half inch in thickness. Each goal strip rests upon the floor member and terminates about three inches above it. Ordinarily the goal strips will be identical. When this is the case each goal strip will desirably have a center notch 19 in its lower margin measuring about three-quarters of an inch in height and four and one-half inches in length. Each strip also desirably has a scoring notch 20 in each end measuring about three-quarters of an inch in height and four inches in length.

The goal strip notches provide three scoring slots in the bottom margin of each goal strip, through any one of which a puck 22 or a puck 25 may be driven. There is nothing rigid about the lengths of the scoring slots or any of the other dimensions given and, in fact, the goal strips may be varied as will be made clear.

In point of fact, the goal strips are merely slid removably into vertical slots 24 formed in the side walls 14 so that substitution can be made at will of other goal strips having scoring notches of different widths and therefore of different difficulty from the particular goal strips just described. In making such substitution the two goal strips may be chosen of equal difficulty or of unequal difficulty, the relative difficulty being a function of the lengths of the scoring slots provided. If of unequal diffficulty, the purpose would be to give an advantage to a player of known inferior ability. One pair of goal strips 10 presently made available includes three scoring slots, each about three and one-half inches long.

Another pair 26 provides a center slot six and one-half inches long and side slots each five and one-quarter inches long.

The above dimensions are, of course, purely illustrative.

In all instances, however, the center slot is at least as long as the side slots and preferably somewhat longer. Even so, it is harder to score through the center slot despite the fact that both the right hand paddle and the left hand paddle are available from a center position of the player for its defense, because it is relatively easy to bank shots into the side slots. Accordingly, one point is credited for each corner slot goal, and three points are credited for each center slot goal.

Insets 27 of rubbery material, such as neoprene, about three-quarters of an inch wide and three-sixteenths of an inch thick are provided along the lower exposed margins of the side walls and of the goal strips. The circumferential surface of the puck may be similarly coated with insets of rubbery material.

The rubbery coatings add to the liveliness of the game and at the same time make the game much quieter to play.

A choice of pucks 22 or 25 is desirably provided, one measuring an inch and three-quarters in over-all diameter and the other measuring two inches in over-all diameter. The puck body is desirably composed of plywood and the applied covering of rubbery material is so applied that it will not engage the playing surface of the floor member 12.

Because different point counts are awarded for scoring through a center slot and through a corner slot, it is desirable always to trap the puck in an end compartment characteristically associated with the slot through which the score was made. To this end each end zone is divided into three compartments by two partition strips 28.

Since there is a tendency of the puck to rebound onto the playing surface, triangular filler blocks 30 are fixed in the outer corners of the corner compartments, and a wedge-shaped filler block 31 is fixed against the outer wall of the center compartment. These filler blocks tend to deflect the puck sidewise so that it will be trapped or at least slowed down in the compartment.

The floor member 12 has a conspicuous center line 32 drawn across it for dividing the playing limits of the respective opposing players into distinct courts.

Each paddle 34 desirably consists of a piece of plywood three-eighths of an inch thick and is generally rectangular in form, but has rounded corners. The illustrative paddles are desirably four inches wide and five and one-half inches long. When placed with a shorter edge resting on the playing surface, the upper margin extends two and one-half inches above the goal strip and above the upper ends of the partition strips 28.

This affords an opportunity for comfortably grasping a paddle without liability of mashing a thumb between the paddle and any upstanding wall of the tray.

As thus far described, it will be apparent that the game can be adapted by choice of pucks and choice of goal strips to the taste and skill of players of all ages; also that the choice of equal or unequal goal strips provides for interesting competition between old and young or between strong and weak players.

As a further alternative, a further pair of goal strips 36 is provided, having a single center scoring notch. When these goal strips are used, the game more nearly resembles hockey, and each player may be allowed to use only one paddle. The rules, however, can be varied by mutual consent. In some circumstances it may even be interesting to allow one paddle to one player and two paddles to his opponent.

I have described what I believe to be the best embodiment of my invention. What I desire to cover by letters patent, however, is set forth in the appended claims.

I claim:

1. Playing equipment for a puck and paddle game comprising, the combinations with a puck and hand held playing paddles of an open tray which includes upstanding side and end wall members, a floor member that provides a playing surface divided into courts by a center line, and goal strips at opposite ends of the tray having scoring slots through any one of which the puck may be driven, said side walls having pairs of transversely aligned vertical slots in which the ends of the respective goal strips may be slidably and removably contained, the lower margins of the side walls and the goal strips being coated with a covering of rubbery material to increase the rebounding liveliness of said members while deadening the sound producing by the playing of the game.

2. Playing equipment as set forth in claim 1 which includes a puck in the form of a thin circular disc surrounded by a band of rubbery material.

3. Playing game equipment as set forth in claim 1, in which two paddles are provided for each player's simultaneous use, each goal strip provides three scoring slots so that each player may be required to defend more scoring slots than he has paddles.

4. Playing game equipment as set forth in claim 3 in which the scoring slots of individual goal strips may be made to vary in difficulty by varying the location, number and the extent thereof so that different scoring values may fairly be assigned to different slots and the end zone space between each goal strip and the associated end wall is subdivided by partitions into separate compartments, one for each scoring slot, so that a scored puck may be retained in association with the slot through which it was scored for clearly indicating the score correctly to be allotted.

5. Playing game equipment as set forth in claim 4 in which triangular deflectors are provided in the respective compartments for diverting scored pucks from rebounding through the associated slot onto the playing area.

6. Playing game equipment as set forth in claim 3 in which each goal strip and the associated partitions are of considerably less height than the side and end walls and the paddles exceed in length the height of a goal strip and associated partitions sufficiently to afford a clear paddle grasping paddle margin when the lower end of a paddle rests on the playing surface, so that all liability of mashing a thumb or finger between the paddle and a goal strip or partition is obviated.

* * * * *

UNITED STATES PATENT OFFICE

CERTIFICATE OF CORRECTION

Patent No. 4,032,150 Dated June 28, 1977

Inventor(s) David C. Wilson

It is certified that error appears in the above-identified patent and that said Letters Patent are hereby corrected as shown below:

Claim 1, column 3, line 37, "combinations" should read -- combination --.

Column 4, line 7, "producing" should read -- produced --.

Claim 3 should read as follows:

-- 3. Playing game equipment as set forth in claim 1, in which two paddles are provided for each player's simultaneous use, each goal strip being spaced from a respective end wall member to define an end zone space at each end of said tray and provides three scoring slots so that each player may be required to defend more scoring slots than he has paddles. --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*